US008720872B2

(12) United States Patent
DeMoss et al.

(10) Patent No.: US 8,720,872 B2
(45) Date of Patent: May 13, 2014

(54) INNERSPRINGS WITH ALTERNATING COIL SPRING ORIENTATIONS

(71) Applicant: Sealy Technology LLC, Trinity, NC (US)

(72) Inventors: Larry K. DeMoss, Greensboro, NC (US); Brian M. Manuszak, Thomasville, NC (US); James A. Beamon, Jamestown, NC (US)

(73) Assignee: Sealy Technology, LLC, Trinity, NC (US)

( * ) Notice: Subject to any disclaimer, the term of this patent is extended or adjusted under 35 U.S.C. 154(b) by 0 days.

(21) Appl. No.: 13/827,387

(22) Filed: Mar. 14, 2013

(65) Prior Publication Data

US 2013/0192003 A1 Aug. 1, 2013

Related U.S. Application Data

(63) Continuation-in-part of application No. 13/010,525, filed on Jan. 20, 2011.

(51) Int. Cl.
*F16F 1/06* (2006.01)

(52) U.S. Cl.
USPC ..... 267/166; 267/103; 5/716

(58) Field of Classification Search
USPC ..... 267/166, 91, 103, 142, 166.1, 167, 180; 5/716, 248, 251, 256, 269, 655.7
See application file for complete search history.

(56) References Cited

U.S. PATENT DOCUMENTS

| | | | | |
|---|---|---|---|---|
| 4,726,572 | A * | 2/1988 | Flesher et al. | 267/91 |
| 4,817,924 | A * | 4/1989 | Thoenen | 267/91 |
| 5,584,083 | A * | 12/1996 | Ramsey et al. | 5/271 |
| 6,375,169 | B1 | 4/2002 | McCraw et al. | |
| 7,044,454 | B2 | 5/2006 | Colman et al. | |
| 7,086,425 | B2 | 8/2006 | Widmer | |
| 7,578,016 | B1 * | 8/2009 | McCraw | 5/716 |
| 8,230,538 | B2 * | 7/2012 | Moret et al. | 5/718 |
| 2008/0017271 | A1 | 1/2008 | Haltiner | |

* cited by examiner

*Primary Examiner* — Pamela Rodriguez

(57) ABSTRACT

Innersprings with alternating coil spring orientations have columns of interconnected coils in which the axial orientation of the coils alternates one hundred and eighty degrees column to column.

1 Claim, 12 Drawing Sheets

INNERSPRINGS WITH ALTERNATING COIL SPRING ORIENTATIONS

RELATED APPLICATIONS

This application is a continuation-in-part of U.S. application Ser. No. 13/010,525, filed Jan. 20, 2011.

FIELD OF THE INVENTION

The present disclosure and related inventions pertain generally to spring assemblies and more particularly to innerspring assemblies for use in reflexive support structures such as mattresses and other body support devices.

BACKGROUND OF THE INVENTION

Innerspring assemblies (or "innersprings") are conventionally formed as a matrix or array of individual springs, such as steel wire coil springs, which are interconnected with ends of the springs being arranged in a common plane to provide a reflexive support surface and structure which can be incorporated into a support system or device such as a mattress or seating furniture. Among the wide variety of different types of innersprings, a common form is made with coiled wire springs which have a generally helical coil body with ends at each end of the helix of the body, the ends formed by one or more turns or bends of wire in a single plane to create a planar end which together with adjacent springs in the array create a planar support surface which can bear a load in compression to varying degrees. The helical coil bodies are formed by turns of wire in a right hand or left hand direction about an axis of the coil, and the ends are necessarily formed by additional turns or bends of the wire in the same direction as the coil body. The termination of the wire at each end of the coil spring, also referred to as the "terminal ends", are typically located at a periphery of the coil body, and the opposite terminal ends may be located on the same side of the coil body or on opposite sides of the coil body.

In innerspring assemblies of the prior art, coil springs of this type are uniformly oriented with the ends of the coils in common planes as noted, and with the terminal ends of the coils commonly located with respect to the coil bodies. As noted in the prior art, the helical turn of the wire of the coil body causes the coil to lean or displace laterally when compressed, typically toward the inclined transition from the coil body to the planar coil end. In innersprings in which all of the coil springs are commonly oriented, the lateral displacement is also uniform and magnified by multiple interconnected coil springs. The lateral displacement component of an entire innerspring can be countered or resisted by the encapsulation of the innerspring in an envelope or covering material, but the spring force action of such an innerspring will always have this lateral component.

Other prior art innersprings combine different types of coil springs with differing wire turn direction to attempt to counter or cancel lateral displacement tendency. This presents formidable challenges to automated manufacture of innerspring assemblies.

SUMMARY OF THE PRESENT INVENTION

An innerspring assembly of a matrix of coil springs arranged in rows and columns, each coil spring having a generally helical coil body with a first coil end formed at a first end of the coil body and second coil end formed at a second end of the coil body, each of the first and second coil ends having a terminal end with the terminal end of the first coil end located on a first side of the coil body, and the terminal end of the second coil end located on a second side of the coil body generally opposite the first side of the coil body, the coil springs arranged in the innerspring in interconnected rows and columns, wherein the coil springs in a first column and every other column from the first column of the innerspring are uniformly oriented with the first terminal end toward a first side of the innerspring, and the coil springs in a second column immediately adjacent to the first column, and every other column from the second column of the innerspring oriented with the first terminal end toward a second side of the innerspring.

DETAILED DESCRIPTION OF A PREFERRED EMBODIMENT OF THE INVENTION

Figure 5:
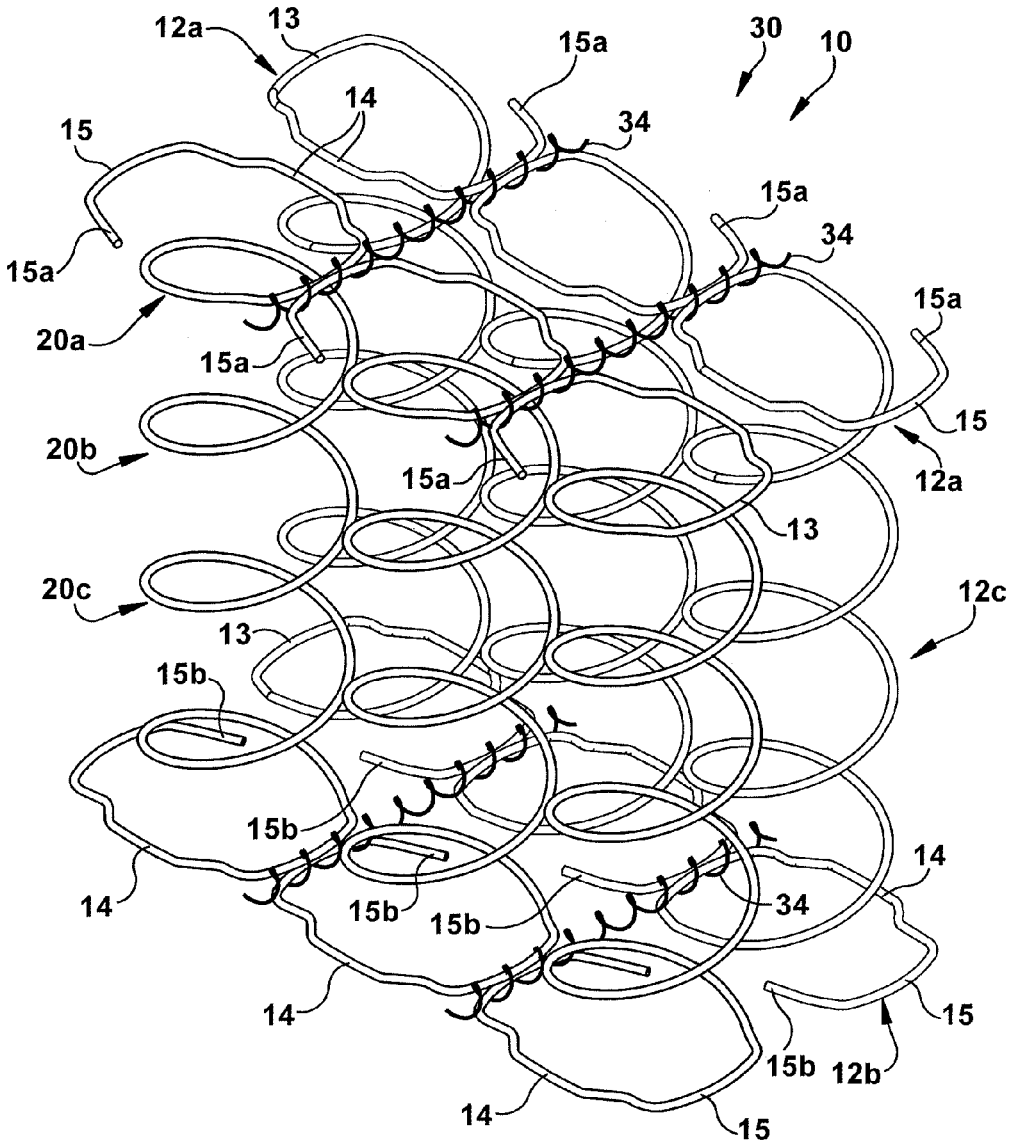
FIG. 5 is a perspective view of a portion of an embodiment of an innerspring assembly of the present disclosure.
Figure 6:
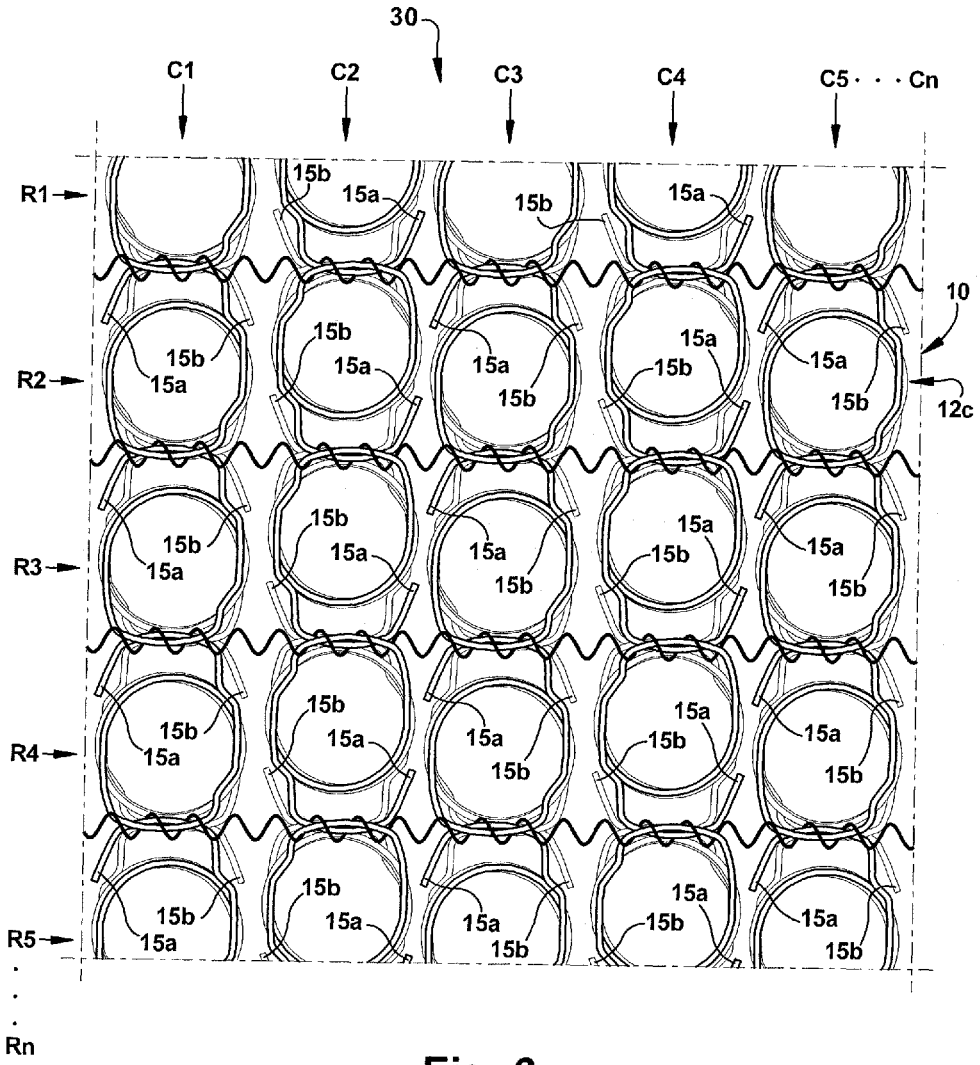
FIG. 6 is a plan view of an innerspring assembly of the present disclosure.

As shown in FIGS. 5 and 6, a portion of an innerspring assembly (or simply "innerspring"), a portion of which is generally indicated at 30, which has an alternating coil spring orientation in accordance with the present disclosure. The innerspring 30 is formed of multiple coil springs, or simply "coils" indicated at 10 arranged in a matrix of multiple parallel columns C (for example columns C1-C5 . . . Cn) and corresponding parallel rows R (for example rows R1-R5 . . . Rn). Of course innersprings of different sizes may have different total numbers of columns and rows of coils. The coils 10 are held in this general arrangement in part by lacing wires 34 which extend generally transverse to a length of the innerspring 30, parallel to rows R, and are intertwined or engaged with adjacent coils 10 in the rows and columns, R, C, as further described.

As further described herein, each of the coils 10 has an upper terminal end 15*a* that is located generally lateral to a generally cylindrical and helical coil body 12*c* from which the terminal end 15*a* extends. As best shown in FIG. 6, the upper terminal ends 15*a* of the coils 10 in column C1 are disposed or located laterally to the left of the coil body 12*c* of each respective coil, and the upper terminal ends 15*a* of the coils 10 in column C2 are disposed or located laterally to the right of the coil body 12*c* of each respective coil, and the upper terminal ends 15*a* of the coils 10 in column C3 are disposed or located laterally to the left of the coil body 12*c* of each respective coil in this alternating or repeated alternate orientation pattern across the columns C1-Cn of the innerspring. This pattern of alternating arrangement or orientation of the coils 10, and specifically the orientation of the upper terminal ends 15*a* which together form the primary structural and flexural support surface of the innerspring 30, whether for use in a mattress or other reflexive support structure, in adjacent columns is repeated across a width of the innersprings 30 of the present disclosure, also referred to as "innersprings with alternating coil orientations".

In each column C1-C5 et seq., the upper terminal ends 15*a* of each of the coils 10 alternate in location longitudinally with respect to the coil body 12*c*. For example, the upper terminal end 15*a* of the coil at R2, C1 is located longitudinally opposite to the upper terminal end 15*a* of the coil at R2, C2. In this alternating arrangement of coils 10 wherein the orientation of adjacent coils is opposed 180 degrees both laterally and longitudinally, with reference to the upper terminal ends 15*a* of the coils, any tendencies of the coils to lean, compress or bias in either a lateral or longitudinal direction is effectively cancelled, resulting in an innerspring that provides more directionally controlled support vertically via on-axis compression and generally orthogonal to load forces applied to the innerspring support surface defined by the coil ends. The opposing lateral and longitudinal orientations of the coils cancels or dampens off-axis compression or lean of individual coils and the compounding of lean tendency of an innerspring as a whole in which coils or commonly orientated.

Figure 8:
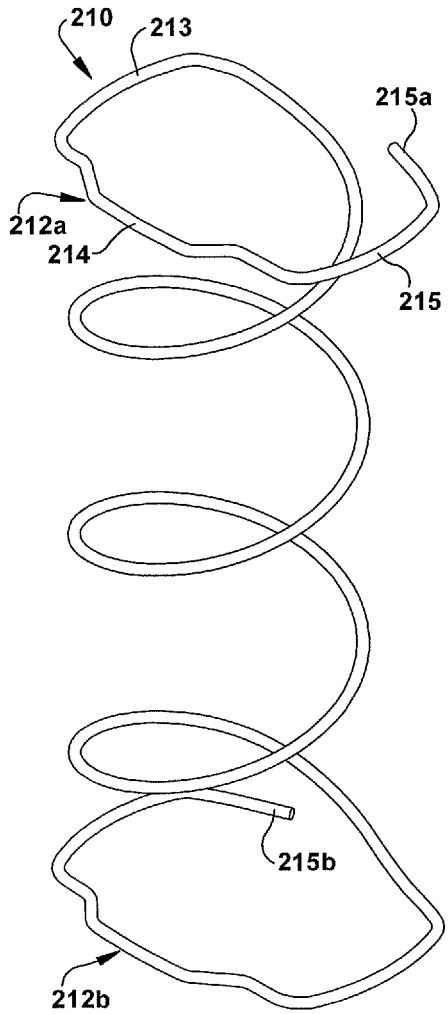
FIG. 8 is a perspective view of the wire coil spring of FIG. 7.
Figure 9:
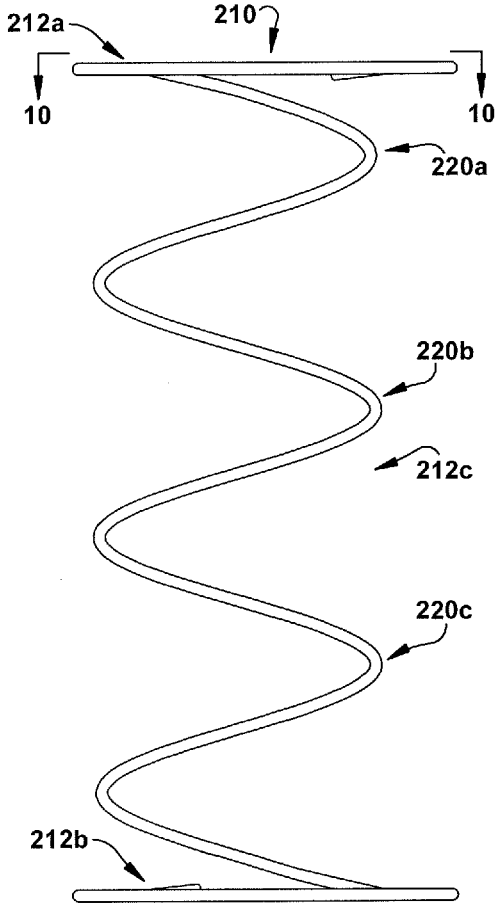
FIG. 9 is a second elevation of the wire coil spring of FIG. 7.
Figure 10:
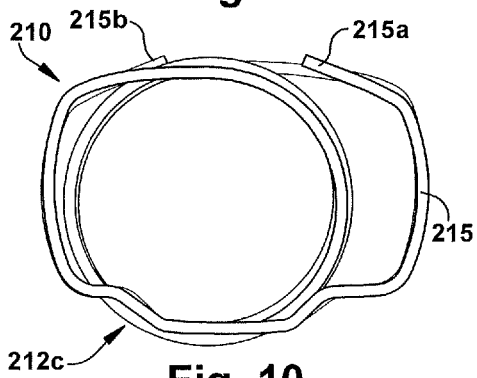
FIG. 10 is an end view of the wire coil spring of FIG. 7.
Figure 11:
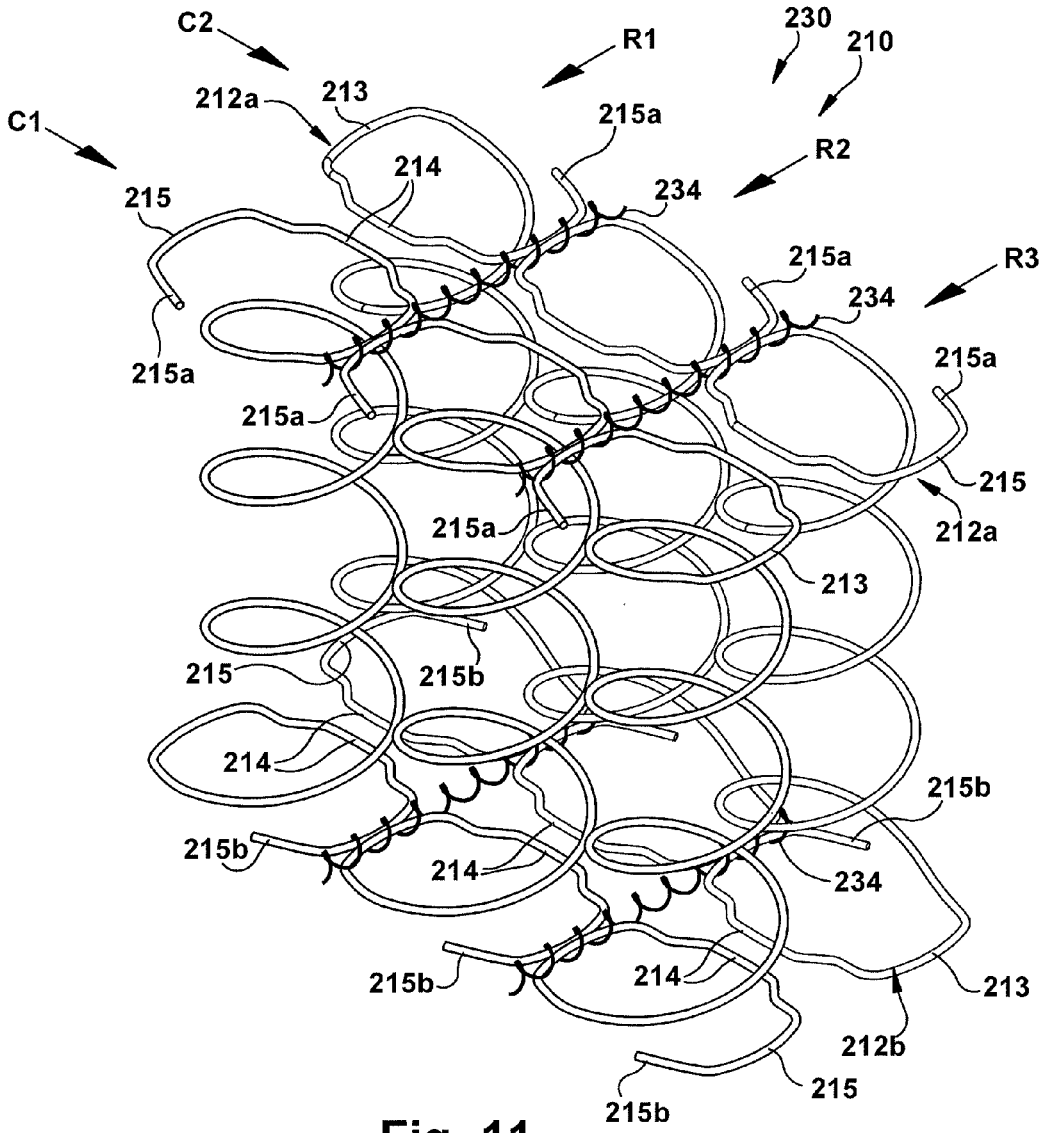
FIG. 11 is a perspective view of a portion of an alternate embodiment of an innerspring of the present disclosure.
Figure 12:
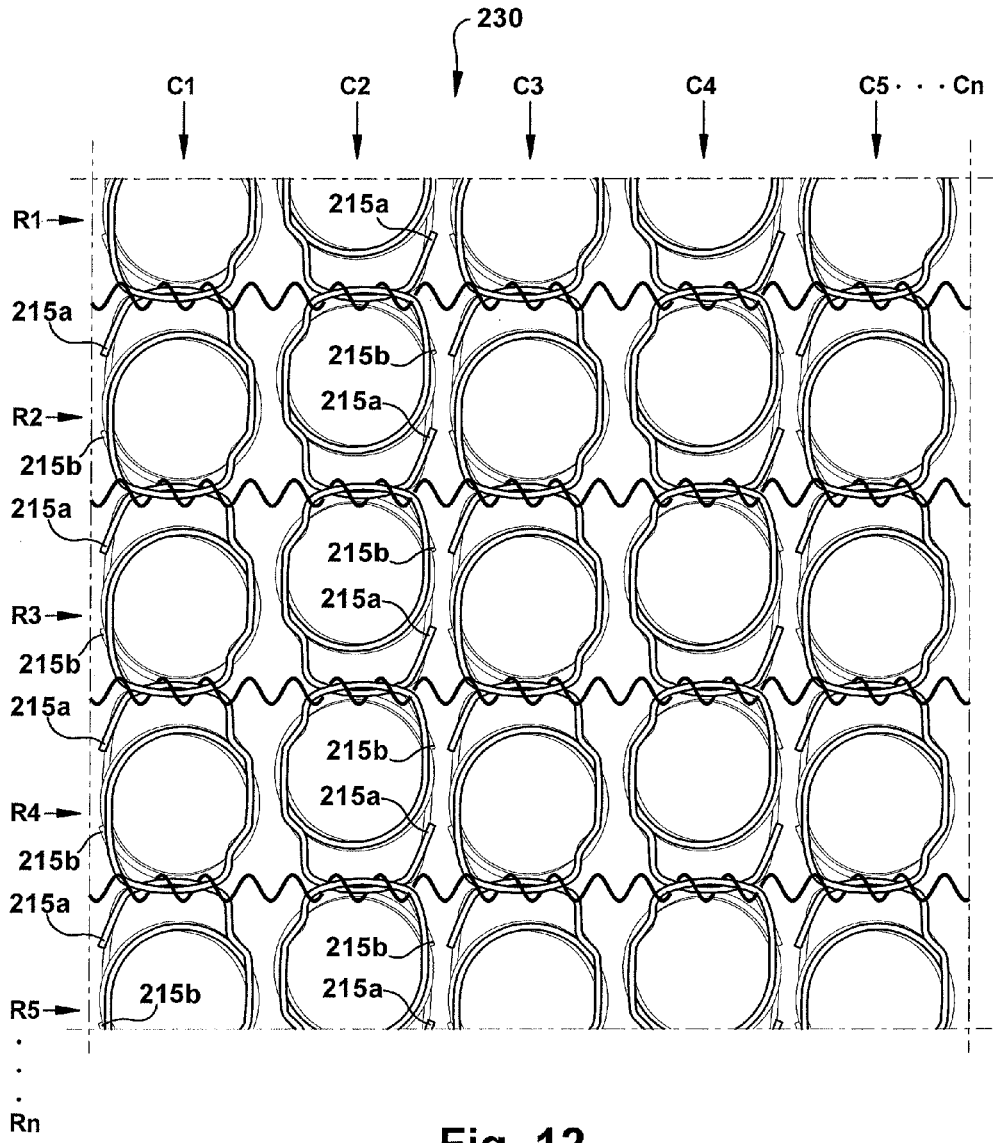
FIG. 12 is a plan view of a portion of an alternate embodiment of an innerspring assembly of the present disclosure.

One type of wire coil spring (or "coil") which can be used in the innersprings of the present disclosure is illustrated singularly in FIGS. 8-10, indicated generally as 210, and in an assembled innerspring 230 illustrated in FIGS. 11 and 12. The coil 210 has generally cylindrical coil body 212*c* formed by a series of helical turns or wire including turns, e.g., turns 220*a*, 220*b* and 220*c*, and opposite coil ends 212*a* and 212*b*, each having a respective upper terminal end 215*a* and lower terminal end 215*b*. The number of coil turns, the diameters or radii of each turn, and the pitch of each turn as determined by a helical angles may vary as known in the art, and the innersprings of the present disclosure are not limited to any particular embodiment. As further shown in individual form in FIGS. 8-10, each of the coil ends 212*a*, 212*b* include a first transition segment 213 from the coil body 212*c*, an offset segment 214, an end segment 215 and a respective terminal end 215*a*, 215*b*. the coil embodiment of FIGS. 8-10 is representative of a "three turn" coil with turns 220*a*, 220*b* and 220*c* which make up the coil body 212*c*, although the disclosure and invention is not limited to any particular number of turns in the coil body 212*c*. As shown in each of the coils 210 the coil ends 215*a*, 215*b* are on the same side of the coil body 212*c*.

As shown in FIGS. 11 and 12, in a particular embodiment of an innerspring of the present disclosure, the coils 210 are assembled in an innerspring, a portion of which is illustrated and indicated at 230, by parallel arrangement of the axes of the coil bodies 212*c* and positioning of the coil ends 212*a* in a common plane and coil ends 212*b* in a common plane.

In column C1 of the innerspring assembly 230, the coils 210 are oriented with the upper terminal ends 215*a* and lower terminal ends 215*b* each positioned generally at a left side of each respective coil body 210, when viewed from above as depicted in FIG. 12. In column C2 of the innerspring assembly 230, the coils 210 are oriented with the upper terminal ends 215*a* and lower terminal ends 215*b* each positioned generally at a right side of each respective coil body 210, when viewed from above as depicted in FIG. 12. And in column C3 of the innerspring assembly 230, the coils 210 are oriented with the upper terminal ends 215*a* and lower terminal ends 215*b* each positioned generally at a left side of each respective coil body 210, when viewed from above as depicted in FIG. 12. This alternating pattern of opposite coil orientation in adjacent columns of the innerspring 230 is repeated in the remaining columns of the innerspring 230 in this particular embodiment. The reverse order of coil orientation is also contemplated, with the terminal ends 215*a* and 215*b* located on the right side of the respective coil bodies in column C1 as viewed from above as in FIG. 12, and terminal ends 215*a* and 215*b* in column C2 located on the left side of the respective coil bodies in column C2, and this alternating pattern repeated in the remaining columns of the innerspring, et seq. However, the alternate 180 degree orientation of the coil ends does not have to occur in every adjacent column or row of the innerspring, as further described.

Figure 1:
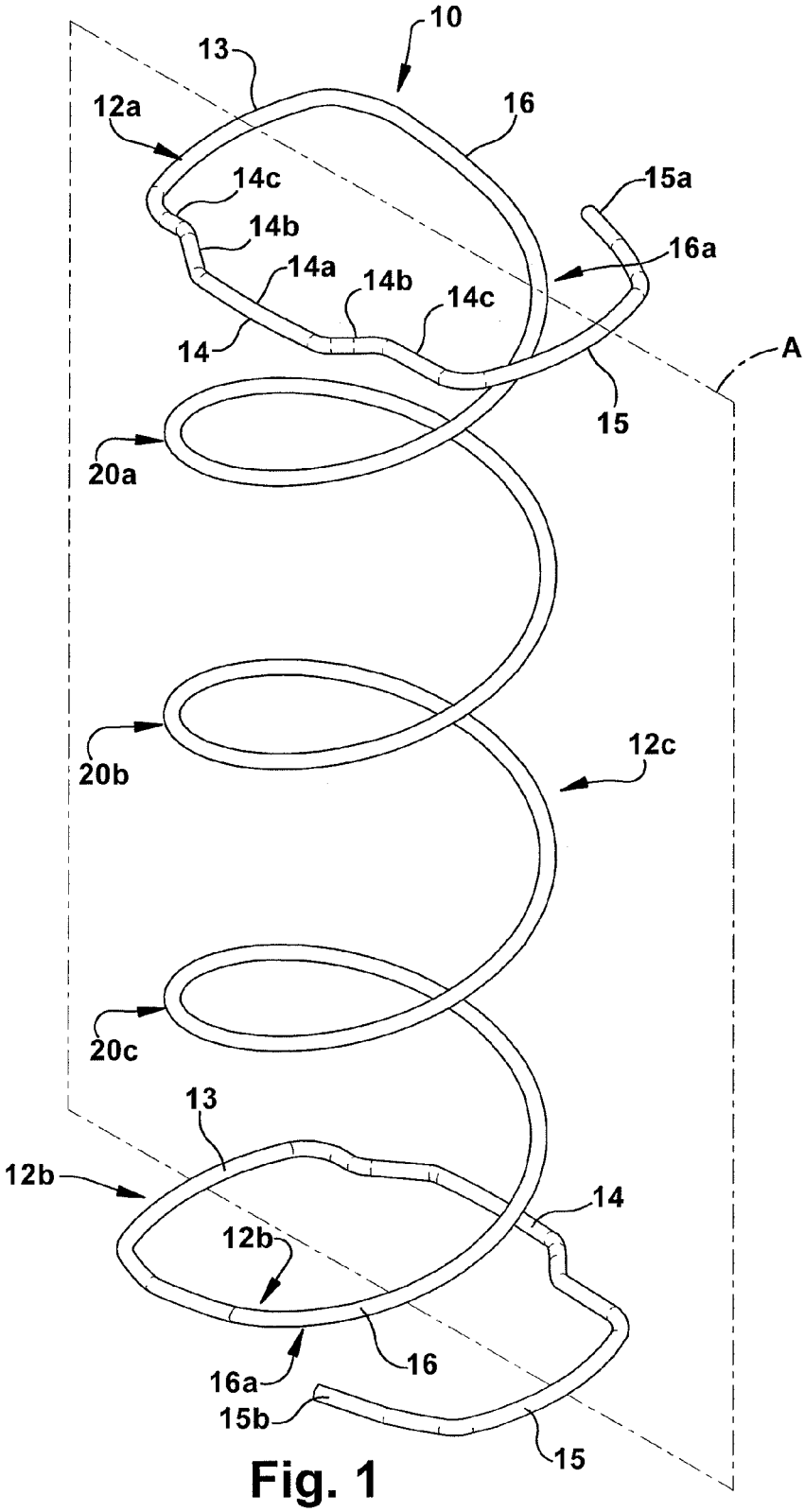
FIG. 1 is a perspective view of a representative embodiment of a wire coil spring of a type which can be assembled in an innerspring assembly of the present disclosure.
Figure 2:
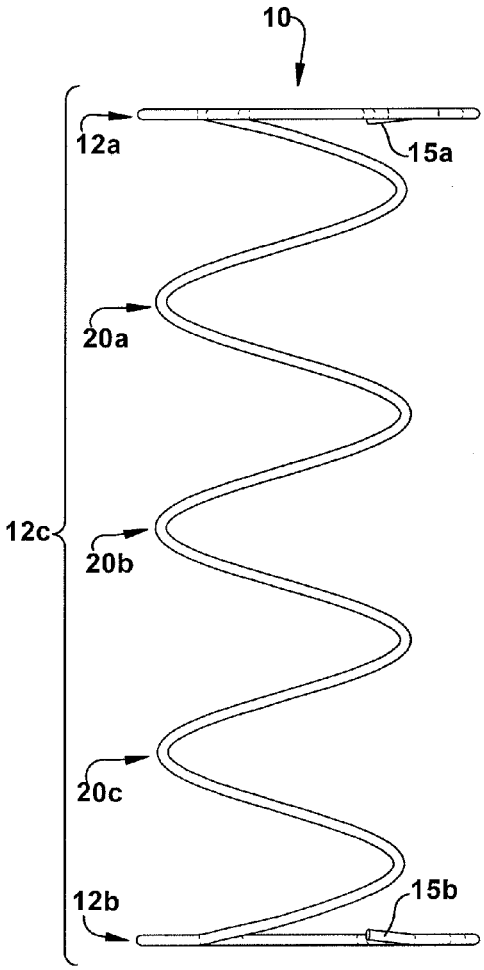
FIG. 2 is a first elevation of the wire coil spring of FIG. 1.
Figure 3:
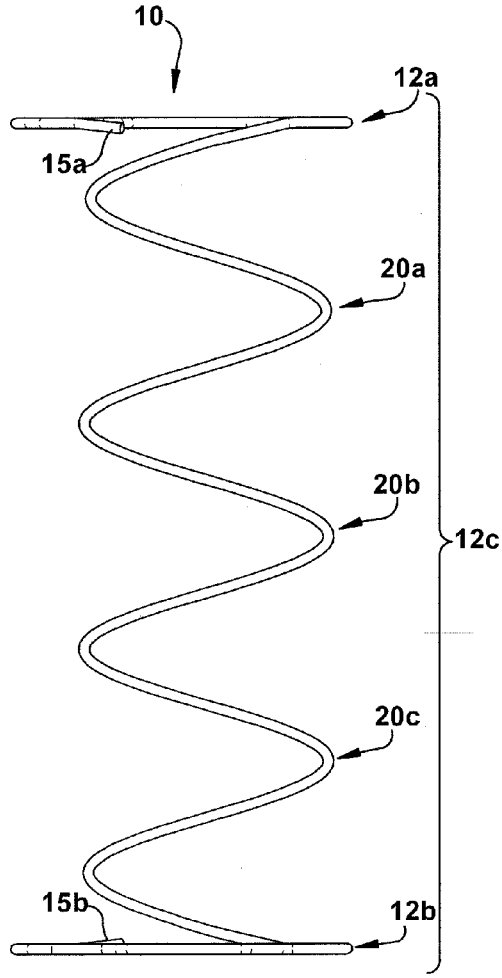
FIG. 3 is a second elevation of the wire coil spring of FIG. 1.
Figure 4:
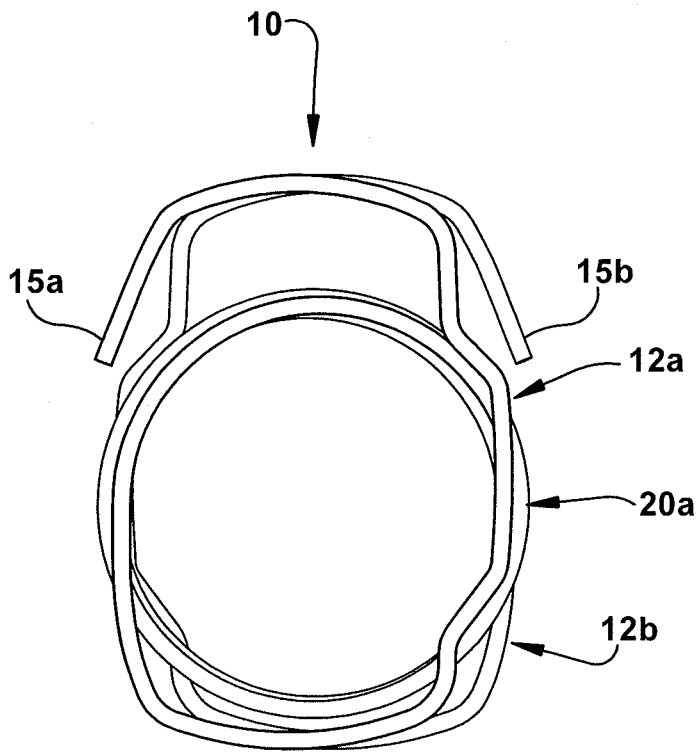
FIG. 4 is an end view of the wire coil spring of FIG. 1, in the direction of the arrows 4-4 in FIG. 3.

FIGS. 1-4 illustrate another embodiment of a coil generally indicated at 10, also referred to as a "reverse coil head" coil or "RCH" and as disclosed in the co-pending and commonly assigned U.S. application Ser. No. 13/010,525. The RCH coil can also be used for assembly in the alternating coil orientation innersprings of the present disclosure. The coil 10 has a generally helical form coil body 12*c* formed of a number of helical turns of spring wire with any suitable pitch or diameter, such as for example turns 20*a*, 20*b* and 20*c*. Contiguous with the coil body 12*c* are coil ends 12*a* and 12*b*, specifically upper coil end 12*a* and lower coil end 12*b*. The coil ends 12*a* and 12*b* can be formed in different configurations and generally in a plane perpendicular to an axis of the coil body 12*c*. In the embodiment shown in FIGS. 1-4, each coil end 12*a*, 12*b* has multiple segments which may be linear, curved, and extend laterally inside or outside of the extent of the coil body. Segments of the coil ends may be linear or curvilinear and may be located within or outside of the diameter of the helical coil body 12*c*. When formed to extend partially or entirely outside of the diameter of the coil body 12*c* these segments of the coil ends are referred to as "offsets", which facilitate inter-engagement between the coils, such as for example by a helical lacing wire 34 which wraps around the offsets of adjacent coils to lace them together, as shown for example in FIGS. 5 and 6. As noted, in the coils 10 of the present disclosure, the opposing coil ends are out of phase and generally diametrically opposed or 180 degrees out of phase with respect to a reference plane A through the body of the coil, as shown in FIG. 1.

The coil body 12*c* has a longitudinal axis which runs the length of the coil generally at the radial of the helical body of the coil. The coil body 12*c* is contiguous with a first coil end 12*a* and second coil end 12*b*. The designations "first coil end" and "second coil end" are for identification and reference only and do not otherwise define the locations or orientations of the ends of a coil. Accordingly, either the first coil end 12*a* or the second coil end 12*b* may alternatively be referred to herein as a "coil end". Either of the coil ends 12*a*, 12*b* may serve as the support end of the coil in an innerspring in a one-sided or two-sided mattress. The two coil ends 12*a*, 12*b* do not have to be identically configured. The coil ends 12*a*, 12*b* lie generally in respective planes generally perpendicular to the longitudinal axis of the coil body 12*c* and form the generally planar support or bottom surfaces of an innerspring. The coil ends 12*a*, 12*b* can be of identical form or dissimilar forms and may have a generally larger diameter than the coil body or have one or more segments which extend laterally beyond the coil body 12*c*.

In the representative embodiment illustrated in FIGS. 1-4, each coil end has a first offset segment 13 which is generally linear and connected to a second offset segment 14 which is also generally linear but which may also include multiple connecting or transition or stepped segments 14*a*, 14*b*, 14*c*, and a terminal offset 15, from which the respective terminal ends 15*a*, 15*b* extend. Each terminal offset 15 has a free or terminal end 15*a*, 15*b* which extends at an angle from the terminal offset 15, and which may be generally parallel to the second offset 14. The terminal ends 15*a*, 15*b* preferably do not extend past the center of the coil to avoid interference with the first convolution of the coil body and prevent a clicking sound or other noise relating to interference with the same or adjacent coils. Preferably, the offset portions are not in the generally helical form of the coil body 12*c* so as to facilitate the described lacing. The offsets 13, 14 and 15 are approximately in the same plane, which is generally perpendicular to an axis of the coil body 12*c*. The coil ends 12*a* and 12*b* of this general configuration are advantageous for allowing the coils 10 to be closely arranged in an innerspring array, and provide a generally linear path for lacing wires 34 that run between and interconnect the coils, as shown in FIGS. 5 and 6. As further shown in FIGS. 5 and 6, the coils 10 are positioned in the innerspring matrix such that the first offsets 13 contact or overlap terminal offsets 15 of the adjacent coils. As further shown in FIG. 5, the overlapped offsets 13 and 15 are connected together by a lacing wire 34 to interconnect entire rows of adjacent coils to form an innerspring 30, a representative portion of which is illustrated in FIGS. 5 and 6. The connected offsets 13 and 15 allow for independent movement of each coil and provide a hinge action at the lacing wire interconnection.

Figure 7:
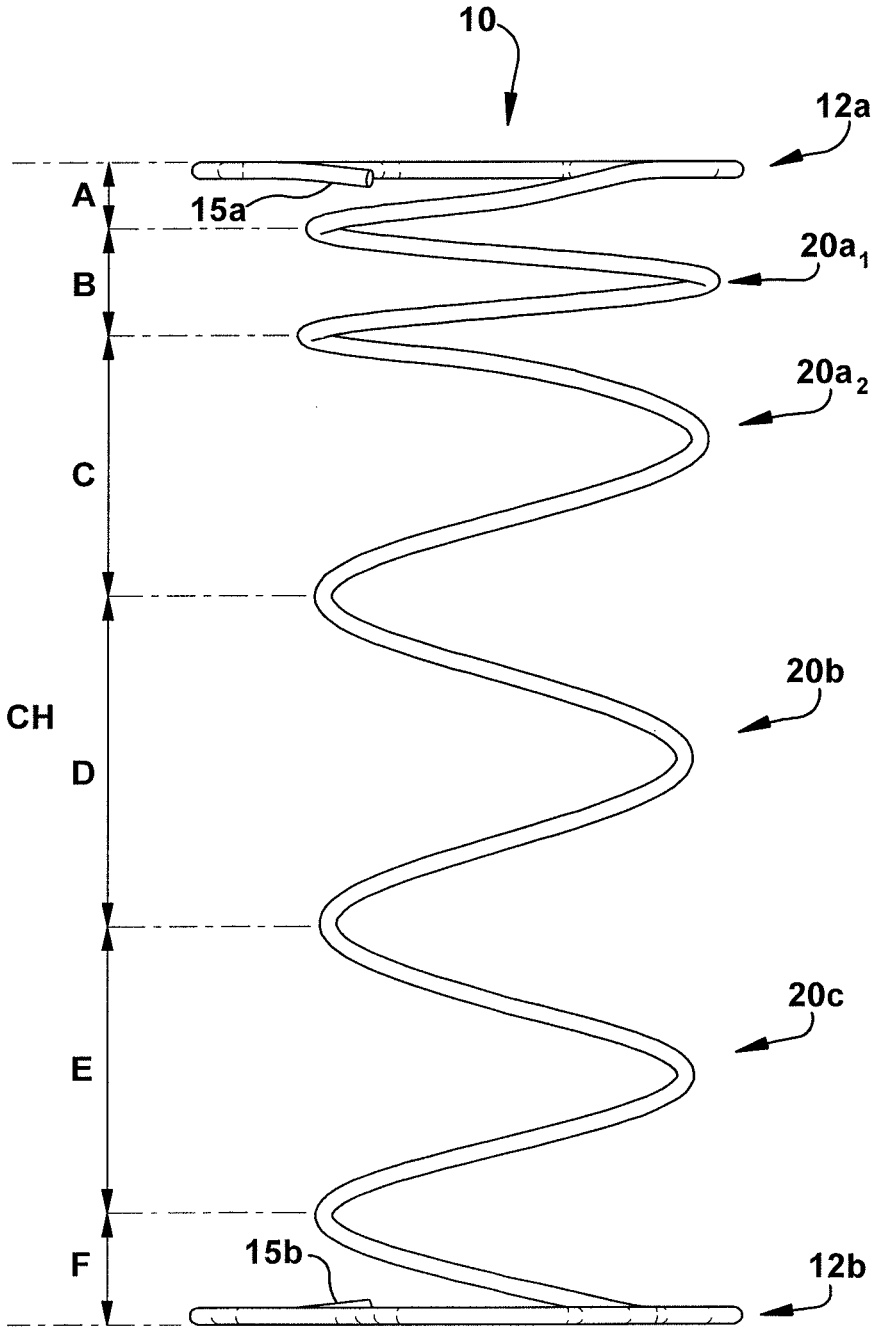
FIG. 7 is a first elevation of an alternate embodiment of a wire coil spring of a type which can be assembled in an innerspring assembly of the present disclosure.

The first offset 13 extends from a transition or connecting segment 16 which connects the coil ends 12*a*, 12*b* to the coil body 12*c*. The integral connection of the connecting segment 16 and the coil body 12*c* is at a transition angle from the helical coil body 12*c* which forms a gradient arm 16*a*, in the general region indicated, which alters the spring rate of the coil under different types of loads. The compression of the coil, and thus the firmness of the coil, can be adjusted within limits by varying the length and angle of the gradient arm 16*a* relative to the coil body 12*c* and coil end 12*a*, 12*b*. The gradient arm 16 adds extra support when a load is applied to the coil, as described in U.S. Pat. No. 4,726,572, which is incorporated herein by reference. FIG. 7 illustrates an alternate embodiment of the coil 10 wherein the coil body 12*c* includes four turns of the helical wire, turns 20*a*1, 20*a*2, 20*b* and 20*c*, with coil ends 12*a* and 12*b* similarly configured as previously described.

FIGS. 5 and 6 illustrate a representative alternate embodiment of an innerspring 30 of the present disclosure, also referred to as an "alternating coil innerspring", made of a plurality of coils 10 interconnected in a matrix or array by arrangement of the coils in columns C1-C5 . . . Cn and rows R1-R5 . . . Rn, with the upper coil ends 12*a* in a common plane and lower coil ends 12*b* in a second parallel plane. In column C1, the upper terminal ends 15*a* of the coil 10 in that column are each located on a left side of the coil body 12*c*, as also shown in FIG. 6. Each respective lower terminal end 15*b* of each of the coils in column C1 is accordingly located on a right side of the coil body 12*c*, consistent with the described configuration of the RCH coils 10. In column C2, the upper terminal ends 15*a* of each coil 10 in that column is located on a right side of the respective coil body 12*c*, and the corresponding lower terminal ends 15*b* located on a left side of the coil body 12*c*. This alternating pattern is repeated in the rest of the columns of coils in the innerspring 30 in the illustrated embodiment. However, the alternate 180 degree orientation of the coil ends does not have to occur in every adjacent column or row of the innerspring, as further described. To the extent that the coils 10 have any tendency to lean or displace laterally when compressed, for example toward the upper terminal end 15*a* and when laced together in the manner of a conventional innerspring of the prior art, that tendency is cancelled or eliminated in the innerspring 30 by the alternating orientation of the coils 10. For example, any tendency of the coil 10 located at column C2 and row R2 to lean or laterally displace in the direction of upper terminal end 15*a* of that coil, is opposed and prevented or cancelled by the same lean or lateral displacement of the coil 10 located at column C3, row R2. The result of the effective cancellation or elimination of lateral displacement tendencies is that the coils at C2, R2 and C3, R2 compress and decompress on-axis. In this respect there are pairs of opposing coils in each row (excepting the coils at the edge of the innerspring such as those in column C1) which co-act to provide on-axis compression and decompression.

Figure 13:
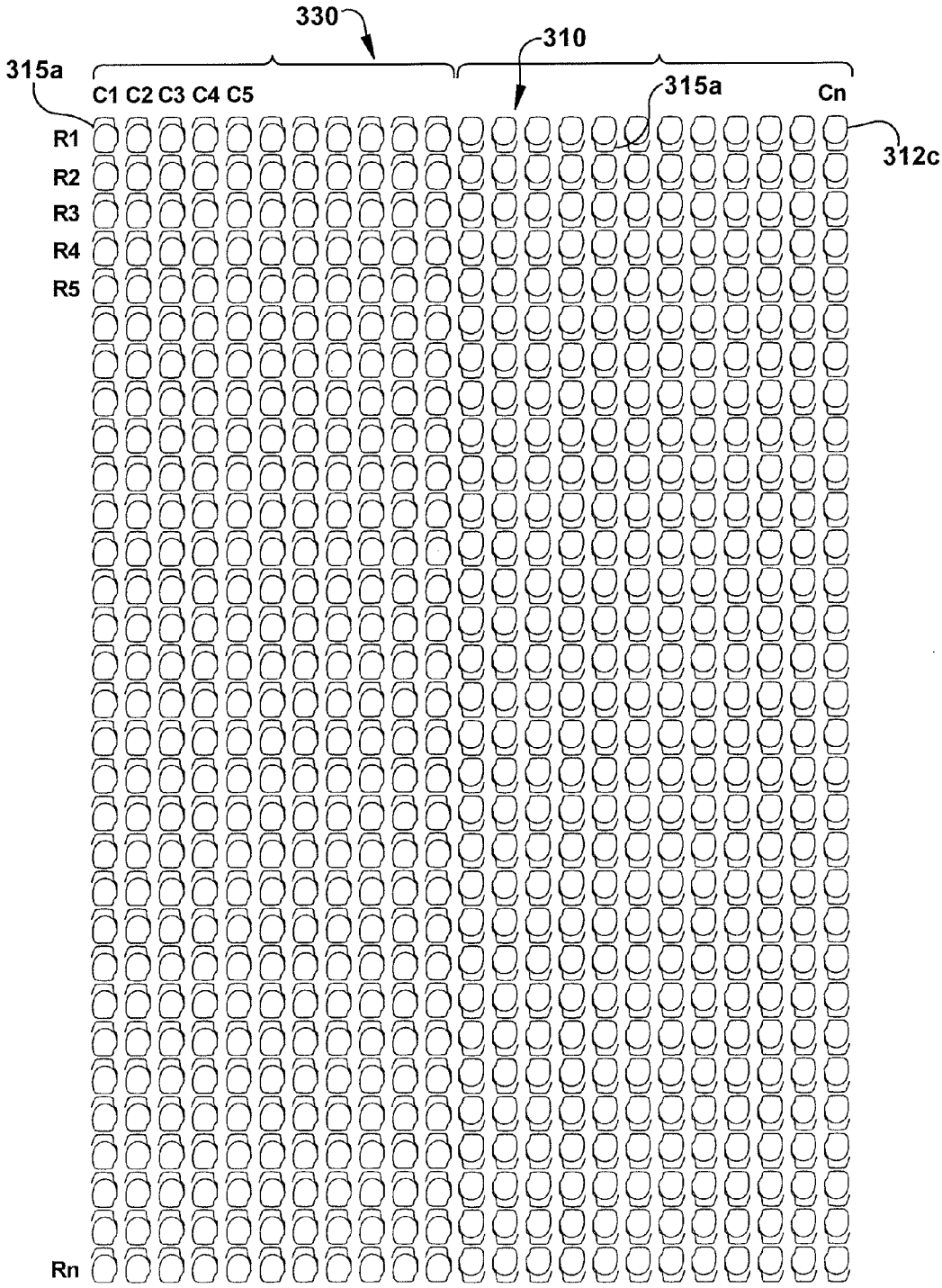
FIG. 13 is a plan view of an additional alternate embodiment of an innerspring assembly of the present disclosure.

FIG. 13 illustrates an additional alternate embodiment of an innerspring assembly of the present invention, indicated generally at 330. The individual coils 310 of this innerspring can be of similar configurations of the previously described coils 10 and 210 with a generally helical coil body 312*c* and upper and lower ends with some or all of the described segments of the ends, including the illustrated upper end 312*a* and terminal ends 315*a*. For the sake of clarity, only the coil body 312 and the upper terminal ends 315*a* are illustrated, it being understood that the lower ends may be configured similarly or identically to the upper ends 312*a*, may be configured differently than the upper ends 312*a*, and may have terminal ends which are located generally on the same side of the coil body 312 (i.e. generally vertically aligned) or not vertically aligned with the upper ends 312*a*, or generally 180 degrees from the upper ends 312*a*, as previously described with reference to coils 10 and 210. Also for the sake of clarity, the coils are shown in their respective orientations but spaced apart from an assembled state wherein the adjacent coil ends are connected together by transverse lacing wires as shown in FIGS. 6 and 12.

In the illustration of FIG. 13, a portion of innerspring 330 is shown from a head end at row R1-Rn and a width of columns C1-Cn. In this particular innerspring 330, the orientation of the coils 310, and specifically the orientation of the upper terminal ends 315*a* differs generally between right and left halves of the innerspring, or in other words between approximately or exactly one half of the total columns C1-Cn. For example, the upper terminal ends 315*a* of the coils 310 in columns C1-C10 are located to the right of each respective coil body 312*c*, and more specifically to the upper right side of the respective coil body 312*c*. The upper terminal ends 315*a* of the coils 310 in columns C11-C22 are located to the left of each respective coil body 312*c*, and more specifically to the lower left of the respective coil body 312*c*. This opposing arrangement of the orientations of the coils 310, and particularly the relative locations of the upper terminal ends 315*a* of the coils on the right and left sides of the innerspring provides a single innerspring which has different support characteristics across its width.

Figure 14:
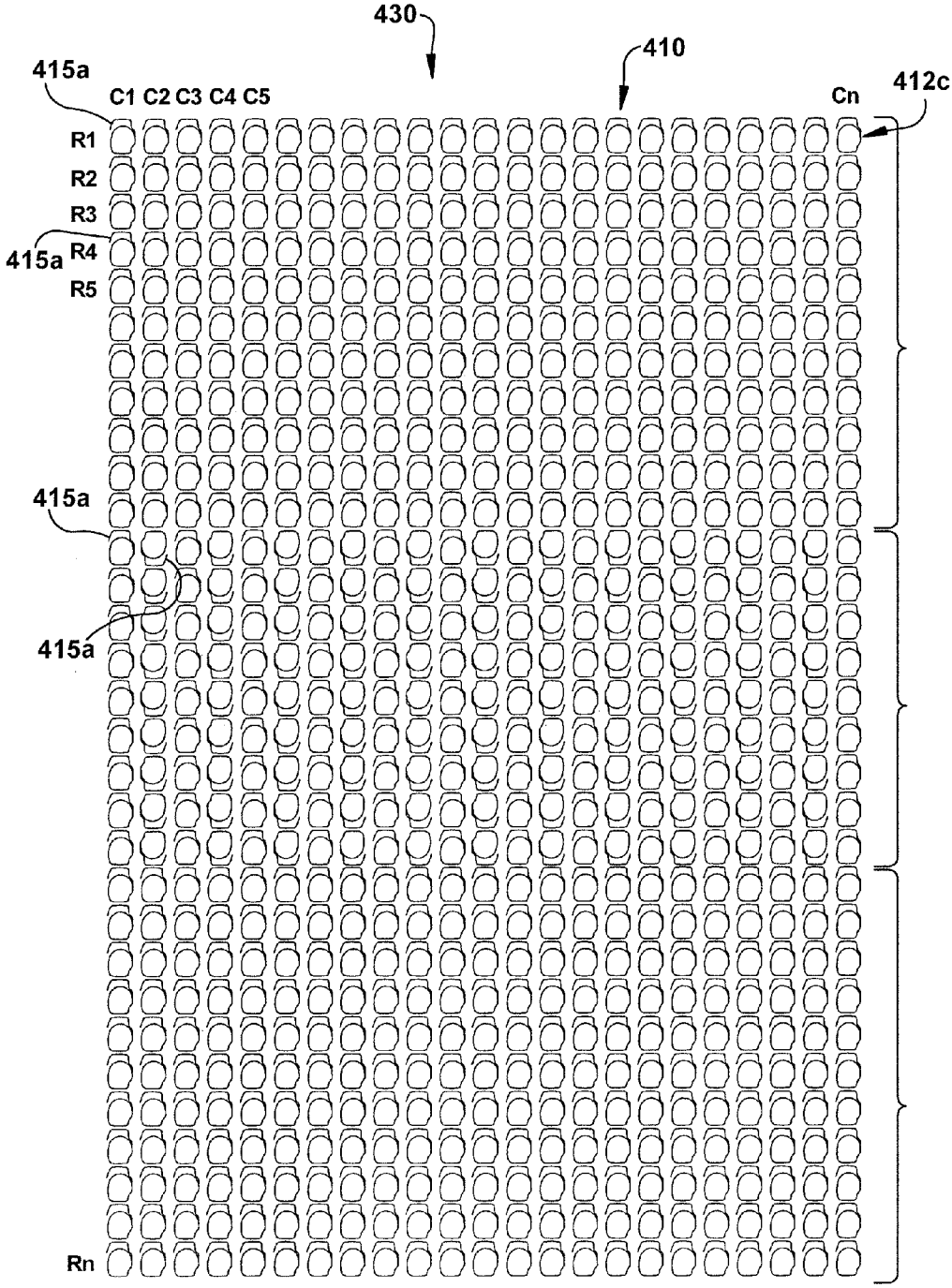
FIG. 14 is a plan view of an additional alternate embodiment of an innerspring assembly of the present disclosure.

FIG. 14 illustrates an additional alternate embodiment of an innerspring 430, portions of which are illustrated schematically and the relative locations and orientations of coils 410, each of which may be in any of the forms described with reference to coils 10, 210 or 310 above. In the innerspring 430, a top or head end includes row R1 and the subsequent rows thereunder (not shown) which may for example anywhere from approximately one tenth to one quarter or more of the total rows of coils 410 of the innerspring 430. The coils 410 in this head region of the innerspring have a particular and uniform orientation, in this case with the upper terminal ends 415*a* located on the right side of the coil body 412*c*. In a central region of the innerspring 430, which in this example is made up of rows RC1-RC5, the coils 410 are in an alternating orientation arrangement the same or similar to that described with reference to FIGS. 6 and 12, with for example the coil 410 located at column C1, row RC1 having its terminal end 415*a* located to the right of the coil body 412*c*, and the coil 410 located at column C2, row RC1 having its terminal end 415*a* located to the left of the coil body 412*c*, and the coil 410 located at column C3, row RC1 having its terminal end 415*a* located to the right of the coil body 412*c* and this pattern repeated throughout the remainder of the row RC1. This alternating orientation of the coils 410 in rows RC1-RC5 of the innerspring as noted creates a different support and reflexive support assembly which has a relatively higher average spring rate resulting from increased on-axis compression achieved by the lateral displacement cancellation effect of the alternating coil orientations. The average spring rate of the region defined by rows RC1-RC5, which may be for example the lumbar region of the innerspring 430, is generally higher than the average spring rate of the other rows R1-Rn, due to the opposed orientation which minimizes or cancels lateral displacement and compresses closer to or on the axes of the coils 410.

Figure 15:
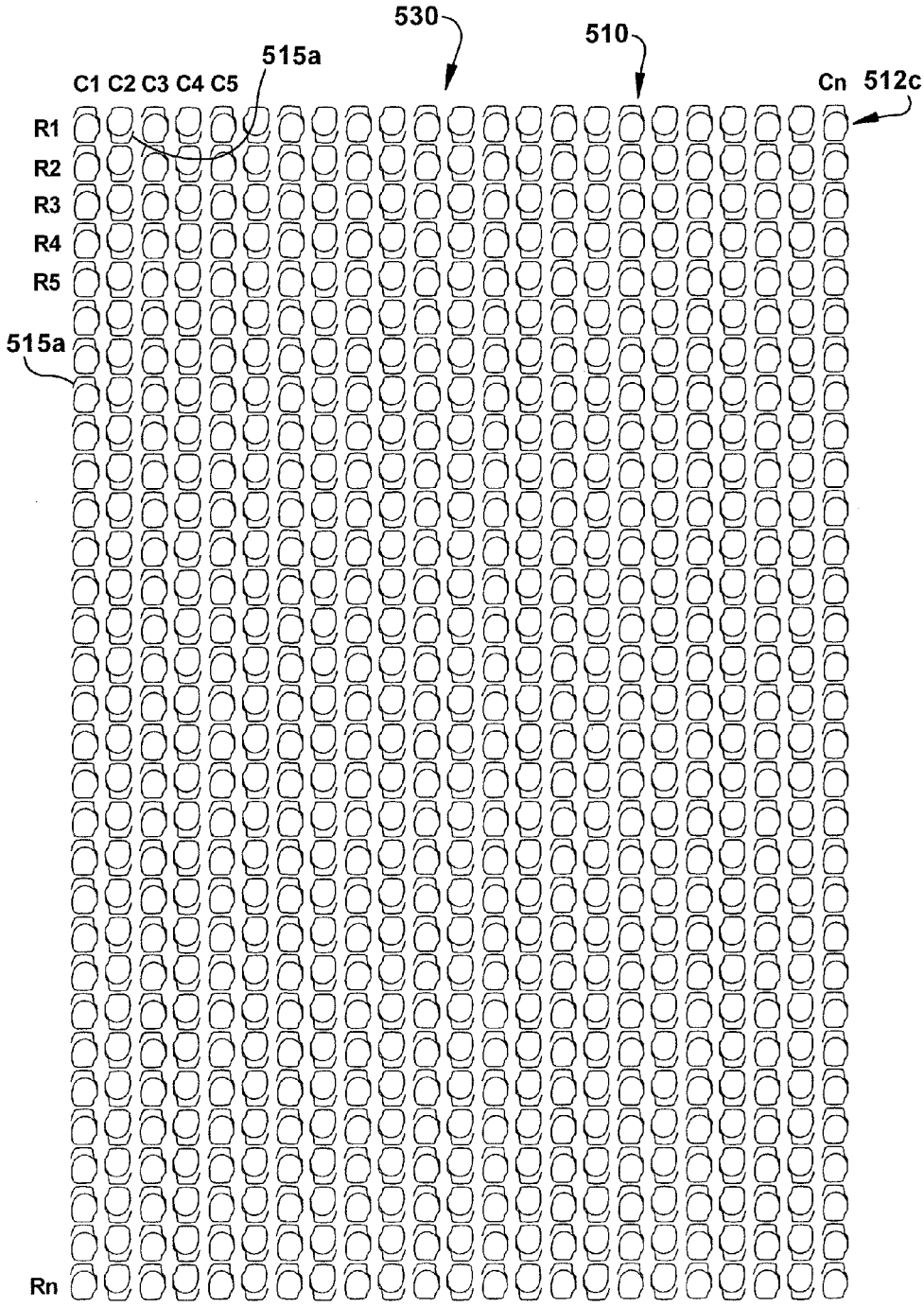
FIG. 15 is a plan view of an additional alternate embodiment of an innerspring assembly of the present disclosure.

FIG. 15 illustrates an additional alternate embodiment of an innerspring 530 of the present disclosure made of coils 510 portions of which are illustrated schematically and the relative locations and orientations of coils 510, each of which may be in any of the forms described with reference to coils 10, 210, 310 or 410 above. The innerspring 510 is similar to innerspring 30 as shown in FIG. 6 and to innerspring 230 shown in FIG. 12 in that the coils 510 have an alternating orientation in each of the rows R1-Rn, in this example with the terminal end 515*a* of the coil located at R1, C1 being located to the right of, or upper right of the coil body 512*c;* the terminal end 515*a* of the coil located at R1, C2 located to the left of, or lower left of the coil body 512*c;* and the terminal end 515*a* of the coil located at R1, C3 being located to the right of, or upper right of the coil body 512*c,* and this pattern repeated for the remainder of row R1 and each of the odd rows R3, R5, etc. in the rest of innerspring. The coils in the even rows R2, R4, etc. have an opposite, 180 degree orientation with the same alternating pattern as in the odd rows. As noted this embodiment provides uniform homogeneous generally on-axis compression resulting in an increased spring rate and elimination of any lean or lateral displacement tendencies.

What is claimed:

1. An innerspring comprising: a plurality of interconnected coils, the coils arranged in an array of columns and rows, each of the coils having a generally cylindrical body formed by helical turns of wire, a first coil end at a first end of the coil body and a second coil end at a second end of the coil body; the first coil end having a plurality of segments of wire formed in a plane generally perpendicular to an axis of the coil body, and a first terminal end located lateral of the coil body; the second coil end having a plurality of segments of wire formed in a plane generally perpendicular to an axis of the coil body, and a second terminal end located lateral of the coil body; a first set of coils located in every other column of the innerspring, the first set of coils having a common orientation with the first terminal end at a first radial position with respect to the corresponding coil body, and a second set of coils located in columns adjacent to the first set of coils, the second set of coils having a common orientation with a terminal end at a second radial position with respect to the corresponding coil body, the second radial position being located on an opposite side of the coil body from the first radial position.

* * * * *